United States Patent [19]

Cusick et al.

[11] 4,382,602

[45] May 10, 1983

[54] REAL ESTATE GAME APPARATUS

[76] Inventors: Timothy H. Cusick, 167 Church St.; Eric R. Giuffrida, 1530 N. Mountain Ave., both of Ashland, Oreg. 97520

[21] Appl. No.: 213,007

[22] Filed: Dec. 4, 1980

Related U.S. Application Data

[63] Continuation of Ser. No. 960,164, Nov. 13, 1978, abandoned.

[51] Int. Cl.[3] ..... A63F 3/00

[52] U.S. Cl. ..... 273/256

[58] Field of Search ..... 273/256, 248, 251, 252

[56] References Cited

U.S. PATENT DOCUMENTS

| | | | |
|---|---|---|---|
| 2,976,044 | 3/1961 | Corpening | 273/256 |
| 3,733,074 | 5/1973 | Daley | 273/248 X |
| 3,765,682 | 10/1973 | Braude | 273/256 |
| 4,223,892 | 9/1980 | Matherne | 273/248 |

*Primary Examiner*—Richard C. Pinkham
*Assistant Examiner*—Scott L. Brown
*Attorney, Agent, or Firm*—Owen L. Lamb

[57] ABSTRACT

A real estate game for amusement and educational purposes. Two tracks are provided around the game board. The outer track is called the Prospecting Circuit, and in the real estate business corresponds to marketing one's services by trying to find prospective real estate listings and buyers. An inner track is also provided, called the Buyer's Circuit upon which listings are placed. This inner track is also for buyers, represented by game pieces, one for each player, which move around the board, the number of spaces being determined by spinning a wheel until one of the buyers lands on one of the player's listings.

4 Claims, 5 Drawing Figures

REAL ESTATE GAME APPARATUS

This application is a continuation of application Ser. No. 960,164, filed Nov. 13, 1978 and since abandoned.

BACKGROUND OF THE INVENTION

1. Field of the Invention

The invention relates to games, and more particularly, to a game for educating an agent in the basics of buying and selling property such as real estate, personal property, insurance, etc.

2. Description of the Prior Art

Various schools exist where one can learn the basics of the real estate business in preparation for qualifying for the real estate broker's examination, which entitles one to be licensed to sell real property in a particular state. There are certain principles that one learns through direct experience while working in the field actually selling real estate. While these principles may be taught theoretically, many people will not put them into practice until they have experienced their value by either success or failure in selling real estate. This on-the-job training can take several months. There is a need to help people gain experience and knowledge rapidly. Training that emphasizes effective prospecting methods and teaches one how to identify qualified buyers is essential. One way to teach is through the use of educational games. By playing a game which artificially recreates a real-life situation, a player learns by experience in much the same way one learns in real life. By experiencing failures and mistakes in a game situation one can avoid costly errors in both time and money.

Several attempts have been made in the past to create educational and/or amusement games relating to either the sale of property or property investment. The following is a summary of some of the prior patents.

Gingras U.S. Pat. No. 1,085,202 discloses a real-estate type of game which is intended to be instructional in the details of real estate transactions. The game board is divided into four playing fields, which in turn are divided into ten lots each. A deck of 40 cards is provided, one card is for each lot. A spinner is provided which is divided into a series of events (such as tornado, fire, etc.), which by means of chance cause the game to progress. The game continues until one player has all the spaces in a particular field covered by at least one card.

While this particular patent does relate to real estate transactions, it does not teach the basics of real estate brokerage, that is, how to distinguish between different types of buyers and how to prospect for property listings.

Phillips U.S. Pat. No. 1,509,312 shows an amusement type of game having various properties located around an outer track. The game includes dice, a deck of cards, and play money. The object of the game is to acquire as much property as possible and accumulate money by renting the property. This patent does not teach the fundamentals of real estate prospecting.

Braude U.S. Pat. No. 3,765,682 discloses a property investment game. It includes a first path having a number of spaces which identify different shares of property such as gold, insurance, furniture, etc. A marker moves along the first path in accordance with the throw of dice. A price chart is also provided on a second path along which a second marker can move in accordance with the throw of the dice. This second path indicates different market prices lying numerically in order. This patent is concerned with stock market transactions and does not attempt to teach the principles of real estate selling. For example, it does not teach the principles of prospecting for listings nor does it teach how to distinguish between different types of buyers.

Potts et al. U.S. Pat. No. 3,801,104 discloses a game which relates to investment in land and prospecting for oil. The game board has a play path around the periphery thereof, broken down into numbered spaces. In the center of the board is an outlined area (the State of Texas) with different properties corresponding to the numbered spaces around the periphery. Dice are used to progress the game, the object being to simulate business transactions and options with respect to acquiring oil fields. This game does relate to the acquisition of property; however, it does not teach the basic principles of how to prospect for property listings and how to distinguish between different types of buyers.

Small et al. U.S. Pat. No. 3,892,408 discloses an educational real estate type of game. The game board is covered with squares representing contiguous parcels of real property. Property ownership markers are provided for each player and players are dealt cards from a stack. Cards have game instructions on them such as "Purchase any $2,000-owned property." The object of this game is to teach broad legal principles applicable to the acquisition of rights-of-way by public and private utilities. To win, one must establish a continuous path across the board, the path representing the acquisition of a complete right-of-way. This game does not teach the fundamentals of residential-type of real property transactions since it is concerned with the acquisition of rights-of-way by utilities. The game does not teach various prospecting techniques nor does it teach how to distinguish betweeen different types of buyers.

Cowan U.S. Pat. No. 4,053,157 discloses a game in which a game board has a number of squares along each of its sides having directional or instructional information printed thereon. A number of information cards and play-directing cards are provided having information printed thereon, which relates to the information in the various game board squares. There are movable game pieces resembling human beings and motor vehicles. The human being game piece is moved about the board with the throw of the dice. A player follows the instructions (such as "collect on your property") on the game board square upon which the human being has come to rest. Upon accumulating enough money, the player may purchase a second game piece, an automobile. Now the player may throw the dice and move the second game piece in a two-step sequence. First it is moved a number of spaces corresponding to the value on the pair of dice and, after following the instructions on the game board square upon which the game piece has come to rest, the second game piece is moved a number of squares corresponding to the value indicated on the other die of the thrown pair of dice. The winner of the game is the first player to accumulate a certain dollar value of assets including money and property.

This patent does not attempt to teach the principles of residential real estate transactions. It does not teach different methods of prospecting for listings nor does it teach how to distinguish between different types of buyers.

Sneathen U.S. Pat. No. 4,076,249 discloses a game board marked as a residential subdivision to simulate development of real estate property and the various stages of construction of lots thereon. The board has a continuous path of blocks representing a street with building lots on the street. The game has movable markers indicating a player's position on a block, play money, and two sets of penalty or reward cards. Further cards are provided representing engineering, sewer and water, paving, building, and sales and rentals contracts. While this game does relate to real estate, it does not attempt to teach the principles of residential real estate selling. It does not teach methods of prospecting, nor does it teach how to distinguish between different types of buyers.

SUMMARY OF THE INVENTION

It is a primary object of this invention to provide a game apparatus for teaching the principles of selling, including teaching various methods of prospecting and the relative values thereof.

It is a further object of this invention to provide an amusement game apparatus that provides enjoyment for the players in addition to teaching the fundamental principles of selling.

A further object of this invention is to provide an educational game apparatus for teaching a player to distinguish between various buyer types.

A still further object of this invention is to provide an educational game apparatus which teaches the relative significance of choice and the relative insignificance of chance in applying various prospecting techniques, to thereby teach a player the importance of choosing priorities of activities.

A further object of this invention is to provide an educational game apparatus which teaches the realities of chance, preparation, diligence, education, and mistakes to thereby teach a new agent the steps necessary to avoid problems in selling.

Briefly, the above objects are accomplished in accordance with the invention by providing a game apparatus having a first track and a first game piece representing a property buyer and a second track with a second game piece representing a prospector or agent. The first track has a series of spaces constituting a path along which the buyer moves a number of steps determined by chance. The second track has a series of spaces constituting a path along which the agent game piece moves a number of steps also dependent on chance. Thus, the game can progress in either a "prospecting for listings" or a "working with buyer" mode in accordance with which mode is selected by a player.

In accordance with an aspect of the invention, the second track is provided with labels on the spaces thereof which relate to basic property "prospecting for listing" business types of action.

The invention has the advantage that it allows new agents to gain experience and knowledge quickly without the risk of making mistakes which are expensive in both time and money.

The invention has the advantage that it can be used by a new agent in either a formal educational environment or at home in a play environment with his family, thus involving his family members in learning and understanding the career that he has chosen.

The foregoing and other objects, features and advantages of the invention will be apparent from the following more particular description of a preferred embodiment of the invention as illustrated in the accompanying drawings.

TABLE OF CONTENTS

ABSTRACT
BACKGROUND OF THE INVENTION
Field of the Invention
Description of the Prior Art
SUMMARY OF THE INVENTION
BRIEF DESCRIPTION OF THE DRAWINGS
DESCRIPTION
1.0 Wheel and Spinner
1.1 Tire kicker
1.2 Investor
1.3 Downgrader
1.4 Upgrader
1.5 Renter
1.6 Sold Owner
1.7 Transferee
1.8 Motel Dweller
2.0 The Game Board
2.1 FSBO
2.2 Farming
2.3 Expired Listing
2.4 Telephone Prospecting
2.5 Open House
2.6 Walk-in Listing
2.7 Touring
2.8 Oops
2.9 Aha
2.10 Open House Today
2.11 Lost Buyer
2.12 Listing Expired Today
3.0 Rules of the Game
3.1 Equipment
3.2 Preparation
3.3 The Play
3.4 Using the Spinner to Obtain Listings
3.5 Obtaining a Buyer
3.6 Identifying the Kind of Buyer Obtained
3.7 Changing a Buyer into a Seller
3.8 Advancing a Buyer Around the Inner Track
3.9 Making a Sale
4.0 Summary

DESCRIPTION

The game consists of a game board, a wheel with a spinner, two packs of cards, eight game pieces representing agents, four game pieces representing buyers, and twenty "For Sale" signs.

Figure 1:
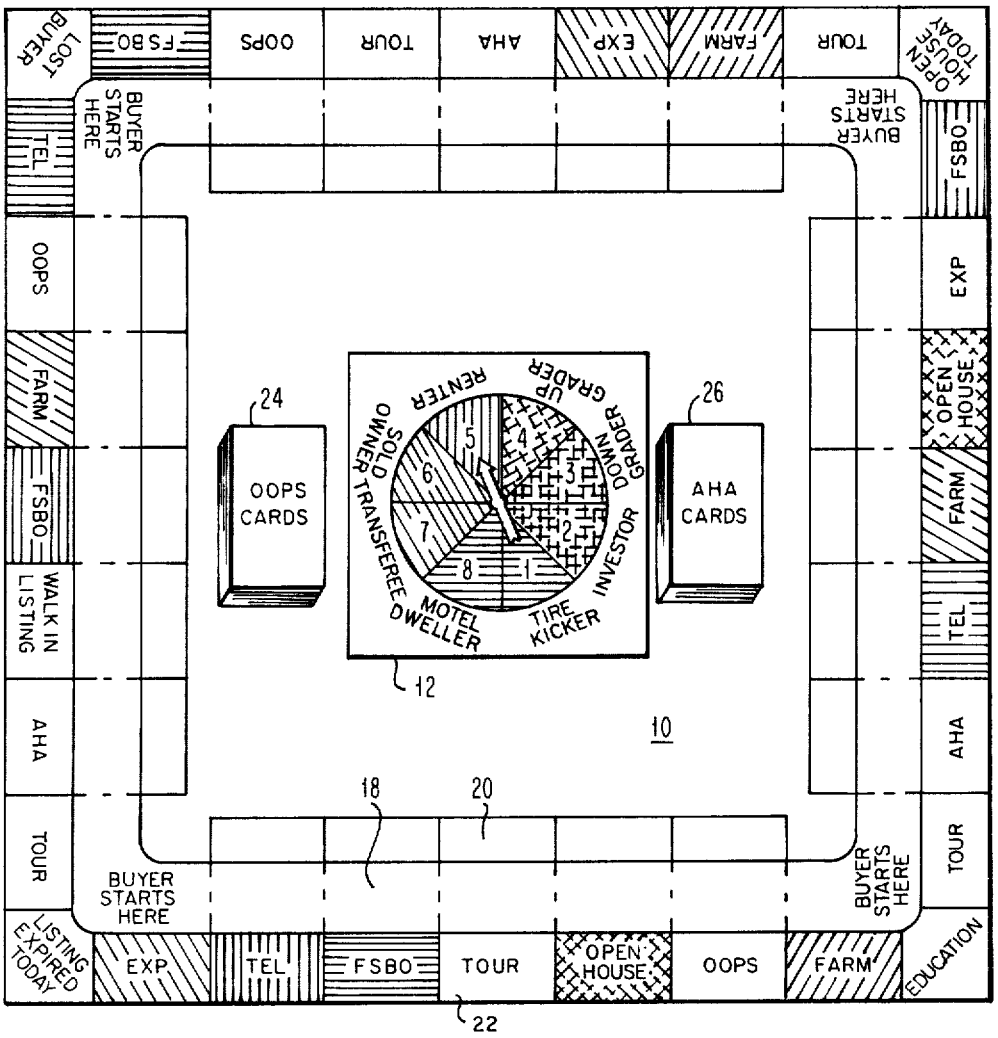
FIG. 1 is a plan view of a game board constructed in accordance with the principles of the invention.

Wheel and Spinner 1.0 Referring now to FIG. 1, a numerical indicating means, (12) is shown which may be a part of the game board (10) or may be a separate game piece. The numerical indicating means comprises a wheel (14) divided up into eight numbered spaces which provide numerical indications. A spinner (16) is provided which may be manually operated. As shown by the hatch marks, the divisions of the wheel (14) are provided with coded indicia which may also be colors. The colors represented are as follows: Blue: 1 and 8; Yellow: 2 and 3; Orange: 4; Red: 5; and Green: 6 and 7.

Associated with each number around the wheel (14) is a label specifying a particular type of buyer. The eight types of buyers are ranked by urgency to buy and/or ability to buy. From an agent's point of view, not all buyers are equally desirable to work with. Top agents have learned how to identify the real buyers and decide which buyers are ready, willing, and able to buy. An agent who fails to properly discriminate between the various types of buyer wastes time with nonbuyers which could be better spent with a more favorable prospect. The game is designed to teach these concepts by increasing the chances of winning, depending upon obtaining a buyer who is more highly motivated. The buyers are listed below in increasing weighted-value order in accordance with the principles of play as described subsequently.

1.1 Tire Kicker (Weight 1). This buyer is identified by the fact that the buyer is not ready, willing, and able to buy. This buyer may be a wishful thinker, but for one reason or another, the buyer is not going to buy a house today or in the near future. Some day the buyer may become a real buyer but now is not the time to do any more than file the buyer's name, address, and phone number for future reference. Keep in touch periodically because the buyer's circumstances may change.

1.2 Investor (Weight 2). An investor is a good buyer to work with provided the investor is properly motivated and willing to pay fair market value. New agents frequently do not possess the knowledge or special skills that are necessary to properly handle this type of buyer. The sophistication of the buyer can easily transcend the abilities of the new agent. Once an agent has gained knowledge and experience, the agent will find investors good people to work with; however, for the purposes of this game the investor is given a low-weighted value.

1.3 Downgrader (Weight 3). A downgrader is a buyer who for some reason wants to buy a smaller or less-expensive home. Perhaps the buyer's family has grown up or for some other reason the buyer no longer needs as large a house. A downgrader is distinguished by two things: (1) this buyer usually needs to sell a house before contemplating the purchase of another; (2) the urgency to move now may be very weak. Individual motivation is probably the key factor. If this buyer is prepared to put the existing home on the market now, then you are working with a serious buyer. Many times this type of buyer needs assurance that a new home would be found before putting up the old home for sale. If this buyer does put the old home up for sale, be careful about spending time with this type of buyer because of the low motivation for moving.

1.4 Upgrader (Weight 4). This describes a buyer who for one reason or another wants to buy a larger or more prestigious home. This type of buyer is similar to a downgrader in that the buyer needs to sell an existing home in order to buy another, and thus motivation becomes a critical issue. If there is a housing shortage (a seller's market) the agent may need to identify a home before the buyer's home is sold, since it may be easier to sell than buy. On the other hand, if there are many homes for sale and buyers can be choosey, (a buyer's market) the agent may find it more difficult to sell the buyer's home than to obtain another suitable home. In these situations, the agent's decision to work with an upgrader may be dependent on the upgrader's willingness to list the existing home on the market now.

Successful agents have found that both Upgraders and Downgraders are really sellers, until the existing home has been sold. It is only after the existing home is sold that the Upgraders and Downgraders are really motivated buyers. The present game treats Upgraders and Downgraders in a special way because of the foregoing, and this will become clear in the subsequent description.

1.5 Renter (Weight 5). The agent's decision to work with a Renter involves qualifying them to determine if they are ready to buy now. Renters are fun to work with because a Renter is frequently a first-time buyer, and this is really a special time for this type of buyer. Since the Renter is highly motivated to move, the weighted value is higher than any of the previously-mentioned types of buyers.

1.6 Sold Owner (Weighted Value 6). Generally Sold Owners are highly motivated, and are ready, willing, and able buyers. This type of buyer has a real estate need that usually has to be solved immediately. For this reason, this is an excellent type of buyer for an agent to work with. Since there is high motivation, an agent should rearrange schedules to fit the needs of this type of buyer.

1.7 Transferee (Weighted Value 7). Transferees are buyers who have just moved into the area and who are on a house-hunting trip with only a few days to find and complete the purchase of a new home. Perhaps they've worked for a corporation, have flown in for a few days, and need to make a decision fast. They are highly motivated buyers and therefore are placed high on the weighted scale.

1.8 Motel Dweller (Weighted Value 8). Motel Dwellers are probably the most-motivated buyer an agent will ever find. They are living in a motel, and if married, they may have furniture in storage and several children. They may already be on the job. This type of buyer needs a house immediately. Thus, this type of buyer has the highest weighted value.

Figures 2A, 2B, 3:
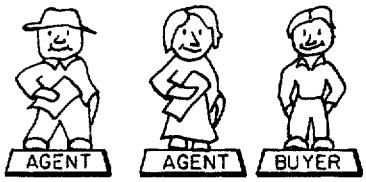
FIG. 2*a* is a drawing of a first game piece representing a male real estate agent.
FIG. 2*b* is a drawing of a first game piece representing a female real estate agent.
FIG. 3 is a drawing of a second game piece representing a buyer.

THE GAME BOARD 2.0 Referring again to FIG. 1, the game board (10) is comprised of two tracks which function as circuits around which the game pieces move during the game. The first, or inner track, is comprised of a series of twenty-four spaces, (18) constituting a path along which a first game piece, a buyer, shown in FIG. 3, can move in a number of steps.

Figure 4:
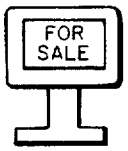
FIG. 4 is a third game piece representing a "for sale" sign.

The first track also has a series of twenty spaces (20) which provide an area upon which a For Sale sign as shown in FIG. 4, may be placed during the course of the game.

A second outer track is provided, having a series of thirty-two spaces (22) comprising a path along which a second game piece representing a real estate agent or a prospector, shown in FIG. 2, can move in a number of steps.

The outside track is divided into several prospecting spaces which relate to basic real estate business actions. These spaces are provided with coded indicia, such as labels or pictures, relating to the particular type of action. The meaning of these labels is given below. Some of the squares in the outer track have further coded indicia, such as colors, to distinguish them from each other for the reasons described subsequently.

2.1 FSBO (For Sale by Owner). (4 Blue spaces) A property that is for sale by owner is a good source of business, because most of these sellers eventually require the services of a real estate agent to sell the property. The best thing about working with this type of seller is that there is a high motivation to sell. They are usually bright people with a flair for doing it yourself. Generally speaking, this type of seller is trying to save the real estate agent's commission, and in a short period of time will come to appreciate the enormity of the task. This type of seller is a good source of referral business provided the agent does a good job, partly because they have a real appreciation for what it takes to sell property.

2.2 Farming. (3 Green spaces) This method of prospecting involves concentrating one's efforts in a small residential neighborhood of about 500 homes. By canvassing the neighborhood, holding open houses, publishing a newsletter, the agent becomes a household name in that particular concentrated area. When people in this area have a real estate need, they immediately think of the agent who has been working in the area.

2.3 Expired Listings. (3 Yellow spaces) It is a reality of real estate business that not every property listed will sell the first time it goes on the market. The owners of property who have tried and failed to sell are a good source of business because they have a need to sell. The code of ethics that realtors subscribe to is such that an agent will not solicit the exclusive listing of another company prior to that company's contract expiring. Oftentimes the listing has expired because the seller was unrealistic about the property the first time or the seller's agent failed to do a serious job of exposing the property. A positive and simple presentation of one's marketing methods is the best way to help sellers who have been through this frustrating experience.

2.4 Telephone Prospecting. (3 Red spaces) This is a very good method of prospecting for listings. The secret lies in the purpose of prospecting. If the purpose is client-centered, or service-centered, the people the agent calls will appreciate that this agent is a hard worker. Later, the people called may turn to this particular agent when the need arises. Lack of understanding about the legitimate purposeful reasons to prospect by telephone is why this excellent method is not more widely used.

2.5 Open House. (2 Orange spaces) An open house is where an agent stays in one particular house for a period of time and advertises that an agent will be there. This is a good source of obtaining listings because many people who come to an open house must first sell a house before another can be purchased. A well-thought out and executed open house is an excellent source of well-qualified and motivated buyers as well. Agents have found that this can be one of the best ways to maximize the exposure of a particular listing.

2.6 Walk-in Listing. (1 Noncolored space) This method of prospecting is the time that an agent spends in receiving calls that come into the agent's office. These calls are initiated by both buyers and sellers on a regular basis. This is a more passive method of prospecting for real estate listings and therefore only one space is set aside on the board. If a player's agent game piece lands on this space, the player gets a new listing automatically.

2.7 Touring. (4 Noncolored spaces) Touring is the process of previewing real estate that is for sale in the marketplace. This is how agents put the existing "inventory" on their "shelves." The successful professionals of the real estate business know what is for sale. By touring, the agent is put into a knowledgeable position to work with the buyers. An agent that knows what is for sale is in an excellent position to help a buyer. Under the rules of the present game, landing on this space is one of the ways that a player obtains a buyer. That is, if a player's agent game piece lands on the touring space, that player is entitled to place a buyer game piece on the space marked "buyer starts here" on the inner track opposite that side of the board on which the player is placed.

2.8 Oops. (3 Noncolored spaces) If a player's agent game piece lands on this space, the player is to draw a card from the stack of Oops cards (24). These cards are penalty cards and are designed to teach the player a positive lesson about real estate, but from a negative point of view. The lessons learned from this deck of cards may cost a player the game, but what is learned now may save the player thousands of dollars in a real-life situation. These cards are provided with penalties which reflect many of the things which can and do happen in real-life sales, such as delays, transactions falling through, client problems, escrow problems, etc. These are the types of things which good planning, thorough preparation, intelligence, virtue, and good looks can't prevent. Alternatively, the Oops instructions may be prerecorded on a cassette tape instead of printed on cards. A list of Oops instructions is provided in the Appendix.

2.9 Aha. (3 Noncolored spaces) When a player's agent game piece lands on one of these spaces, the player is entitled to draw a card from the Aha deck of cards (26). These are reward cards and are to teach reward for good planning, good preparation, and diligent effort. These cards include positive insights into some element of residential sales, and serve to advance the player in the game. Most of these cards are printed with real lessons, but several are included for amusement purposes to make the game more fun and to teach the lesson that one should not underestimate the value of dumb luck, good looks, and virtue. Alternatively, the Aha instructions may be prerecorded on a cassette tape instead of printed on cards. A list of Aha instructions is provided in the Appendix.

2.10 Open House Today. (1 Noncolored corner space) If a player's agent game piece is occupying this space, and if another player's buyer game piece stops in front of the first player's listing, this buyer will buy that listing from the first player. The purpose of this space is to teach the player the real value of holding open houses.

2.11 Lost Buyer. (1 Noncolored corner space) When a player's agent game piece lands on this space, that player must remove one buyer game piece from the board. The purpose of this is to teach the player that it is possible to lose a buyer to another agent or for some other reason.

2.12 Listing Expired Today. (1 Noncolored space) When a player's agent game piece lands on this space, one of the player's listings must be removed from the board, if there is one on the board. A listing contract lasts for a particular time. When that time has expired, the listing no longer belongs to the agent and the player must remove the For Sale sign from the board. In this game, this expired listing goes to one of the other players in the game in accordance with the rules which are described subsequently.

RULES OF THE GAME 3.0 The object of the game is to score 200 points by prospecting for listings, obtaining listings, working with buyers, obtaining buyers, and selling real property by having one of your buyers buy one of your listings. 20 points are given for each purchase.

3.1 Equipment. Equipment consistis of a game board, a wheel with a spinner, eight agent game pieces (four male and four female), four buyer game pieces, twenty For Sale signs a stack of Oops penalty cards, and a stack of Aha cards.

3.2 Preparation. Each player places himself opposite one side of the board. Two-to-four players can be accommodated. Each player selects an agent game piece which is color coordinated to match a buyer game piece, which may also be color coordinated with the Buyer Starts Here on the board opposite the player. The player's agent game piece is initially placed on the space marked Education.

The stack of Oops cards should be placed on the game board as shown at 24, FIG. 1, and the stack of Aha cards should also be placed on the game board at 26, FIG. 1.

3.3 The Play. Each player spins the indicator, 16, to determine the lead-off player. The highest number prevails and everyone else follows in clockwise rotation around the board. Whenever a spin of the wheel results in a tie, the tieing players spin until the tie is broken. At this point in the game, all of the buyer game pieces are off the board and one agent game piece for each player is in the space marked Education.

Play can now begin. The first player spins the wheel and moves the appropriate agent game piece clockwise the indicated number of spaces from the beginning space marked Education. Almost all of the spaces on the prospecting circuit (outer track) involve further action steps or have some consequence. These steps or consequences are to be completed before succeeding players take a turn. The effects of landing on a particular space are determined by the particular label in the space and the color of the space if the space is colored.

3.4 Using The Spinner to Obtain Listings. The colors on certain of the prospecting spaces are the same as the colors inside the wheel (14). When your agent game piece lands on one of these colored spaces, you are given the opportunity to prospect for listings by using the wheel and spinner. This involves taking another turn at spinning the spinner. If the indicator stops at a division on the wheel (14) that is the same color as the space that the agent game piece belonging to you is resting, then you have obtained a new listing on this turn.

When you obtain a new listing, you are entitled to place one For Sale sign on any one of the five spaces, 20, on your side of the board and just inside the buyer track. You may obtain as many listings as you want, up to the five spaces provided. Only one For Sale sign can occupy a particular listing space.

3.5 Obtaining A Buyer. There are several ways that you can obtain a buyer. If during your turn at play your agent game piece lands on the space labeled Tour, you are entitled to place a new buyer on the space marked "Buyer Starts Here" on your side of the board. If you already have a buyer, this space has no consequence, as you are only entitled to have one buyer traveling around the board at a time. You may also obtain a buyer by forfeiture of another player. For example, suppose your agent game piece occupies the Open House Today space. If another player's buyer game piece parked or subsequently parks in front of one of your listings, that player forfeits the buyer to you and you have completed the sale. Both the buyer and the listing are removed from the board upon sale, and you score 20 points.

You may also obtain a buyer upon draw of one of the Aha cards with instructions thereon for you to place a buyer on the board. You may draw an Aha card if your agent game piece lands on one of the spaces marked AHA or the space marked Education.

3.6 Identifying the Kind of Buyer Obtained. Once you have obtained a buyer by one of the methods above, you are entitled to spin the spinner again to determine the kind of buyer you have obtained. If the indicator stops opposite any of the numbers, with the exception of numbers 3 and 4, you must move the buyer you have obtained the number of spaces indicated by the pointer. On subsequent turns you can choose to work with the buyer or prospect for listings by stating your choice verbally, and then spin the spinner.

3.7 Changing a Buyer into a Seller. If the buyer identified is either an Upgrader or a Downgrader, these buyer-types are really sellers, and the game gives the player an opportunity to try to list these seller's house. To convert these buyers into listings involves a second spinning of the wheel. You are entitled to place a new listing on the board if you spin an even number. If you already have five listings on the board, then you are entitled to move an existing buyer through three or four steps, depending on where the indicator pointed on the first spin.

3.8 Advancing a Buyer Around the Inner Track. If you have a buyer on the board you must now decide whether to continue moving that buyer or to prospect for listings when it is your turn. Since you have a choice, you must declare verbally to the other players if you wish to work with your buyer. If you remain silent, it is assumed that you have chosen to work with the outside circuit and thus, would be considered prospecting for listings.

3.9 Making a Sale. The inside track is a circuit around which buyer game pieces move, the number of spaces moved being determined by spinning the spinner. A player's listings are indicated by placing a For Sale sign on one of the five listing spaces, 20, on the player's side of the board. Your buyer game pieces will continue to move around the board until it lands on one of your listings. Having your five spaces full of listings improves the chances of your buyer game piece landing on the proper space. It is possible for you to forfeit your buyer if your game piece in traveling around the board lands opposite one of your opponent's listings and your opponent lands on the space labeled Open House Today. Since you only have one buyer on the board at a time, if you forfeit a buyer, then you must obtain a new buyer by one of the methods described above.

In addition to forfeiting a buyer, you may also forfeit a listing if your agent game piece lands on the space "Listing Expired Today" or if you draw a penalty card with instructions to remove one of your listings. In this event, you must now prospect for listings when it is your turn. Thus, during the course of this game it is advantageous to acquire as many listings as possible. Having a buyer traveling around the circuit is of no advantage to you if you have no listings, and it is an advantage to your opponent as your opponent may consumate a sale with your buyer through one of the mechanisms described above.

SUMMARY 4.0 A game apparatus has been described which includes buyer game pieces, agent game pieces, a spinner, and a third game piece representing the fact that property is available or listed for sale. The game progresses in one of two modes, selected by a player when it is that player's turn to play. The first mode is "prospecting" and progresses around a prospecting circuit on the game board. The second mode is "working with buyer" and progresses around a buyer circuit. Successful prospecting results in property being placed for sale on the buyer circuit. Game points are scored when a buyer moving around the buyer circuit lands on a property listing.

The invention has been described with respect to selling real estate, but the principles can be applied to other forms of selling such as selling insurance, securities, personal property, services, etc.

Furthermore, it will be readily understood by those skilled in the art that the principles of the invention can be readily applied to electronic games wherein the game playing area is the surface of an electronic display head, such as cathode ray tube, or similar apparatus. The various game pieces (agent, buyer, for sale sign, etc.) would then be displayed electronically, and move under control of electronic circuits. It should also be apparent that the numerical indicator can be an electronic random number generator. The penalty and reward (Oops and Aha) cards can be replaced by electronic memory with means for displaying the instructions by reading the memory at a particular location, and displaying the instructions on the display head.

Circuits for performing the above functions electronically are well within the current state-of-the-art.

While the invention has been particularly shown and described with reference to a preferred embodiment thereof, it will be understood by those skilled in the art that various changes in form and detail may be made therein without departing from the spirit and scope of the invention.

APPENDIX

Oops Cards Instructions

1. You failed to really listen to your clients needs and consequently have lost your buyer to the competitor on your right. Skilled agents become extremely sensitive in the art of listening and don't project their own values as solutions to their clients needs. If you have no buyer, your competitor gets one, or moves his existing one up to 5 spaces.

2. Your lead buyer has just lost his job and you, sport, have just lost your lead buyer.

3. You did not prepare a switch sheet the last time you were on the floor. A buyer called on an ad, but the property was sold and you had no alternatives. Player on your right was well prepared, had alternate choices readily available and gets a new buyer or moves his existing buyer up to 5 spaces.

4. You just gave out the address of the property you are advertising in the paper to a prospective buyer. This is one of the surest ways known to eliminate yourself. The agent on your right has the buyer now and may now move, at his option, his buyer forward up to 5 spaces!

5. As the listing agent you have failed to exercise some control in qualifying the buyer on a recent coop sale: 90 days have passed, the buyer was a flake, and you just lost your listing to the agent sitting at your right.

6. You didn't drive the neighborhood during your last market analysis and consequently didn't speak with convincing authority about neighborhood values. Your overpriced listing just expired. Competition may now spin the wheel and the competitor with the lowest number gets your listing.

7. Your lead buyer has bad credit. Move that buyer back to the qualifying pool. An in-depth qualifying interview with all your buyers will usually eliminate this kind of setback and waste of time.

8. An appraisal has come in $5,000 low on a recent sale, setting one of your buyers back 5 spaces. Well prepared market analysis will alleviate this happening to you in the future.

9. You have taken only one person of a buyer couple out to see property because they assured you the one would buy whatever the other liked. You lose buyer to agent's Buyer Pool on your left, who knows homes are purchased by comparison by couples who do their comparative shopping together! If player on left has a buyer, that buyer moves forward up to 3 spaces. If player on left has no buyer, player places a buyer on Buyer Pool.

10. You failed to do a market analysis on your last listing appointment. The player on your right was better prepared about the marketplace and gets the new listing you should have had, or if you have any listing he takes the one of his choice.

11. Your buyers' parents think the house you sold them is too small, too expensive, and too cheaply built. Move your buyer back 5 spaces but not past your Buyers Pool. When qualifying young buyers it is a good idea to ask them if anyone else will be consulted before making their deposit. A commitment by them before previewing may prevent problems later.

12. The last time you talked to your seller was 60 days ago when you took the listing. The seller, who is irate, called your broker and demanded the listing be canceled and given to the player on your right. Since you failed to exercise "due diligence," you must comply if you have a listing.

13. A legal hassle has entangled your buyer causing a delay in the sale. Please move an existing buyer back 5 spaces but not past your Buyer Pool.

14. Although you know better than to waste time showing buyers' property prior to an in-depth qualifying interview, you did it anyway. Move a buyer back 5 spaces, you riverboat gambler!

AHA CARDS INSTRUCTIONS

1. Congratulations! You get a new listing because of your servicing program which included:
   1. Knocking 50 doors in the neighborhood announcing the new listing.
   2. Knocking the same 50 doors inviting neighbors to send prospective buyers to your open house and to come themselves.
   3. Knocking the same 50 doors after the sale inquiring for prospective sellers.

2. You had your buyer prequalified by a lender before showing them property. Move your buyer, new or existing, up to 5 spaces forward. This can be a great timesaver, especially with first-time buyers who are buying with minimum down and limited incomes.

3. Interest rates went up and loan commitments are running out. Fortunately you know your banker so well you remembered to send him a birthday card last week. He has remembered you today. Start a new buyer by spinning or advance a buyer up to 5 spaces.

4. You have had qualifying appointments with prospective buyers Monday, Tuesday, and Wednesday of this week. Move a new or existing buyer up to 5 spaces.

5. You have recently completed a Real Estate law course and you understand the four elements of an enforceable contract are:

1. Consent
2. Consideration
3. Understanding
4. A lawful object

Advance a new or existing buyer 5 spaces or retain as a remedy against legal hassles.

6. CONGRATULATIONS! For completing studies in advanced appraisal techniques, you are now qualified to adjust a low ball appraisal in exchange for this card. Please retain this card until you need it.

7. You have had no evening appointments this week. Advance to the nearest telephone and prospect for a listing appointment.

8. You have been consistent about keeping in touch with old clients because of your good follow-up program. Move either a new or existing buyer up to 5 spaces.

9. Your consistent efforts in your farm area have made you the neighborhood expert. Advance to the nearest farm for a listing appointment.

10. Your enthusiastic attitude has resulted in a buyer appointment. Advance to the nearest tour and spin for one of the 8 types of buyers.

11. Your enthusiastic attitude has resulted in an appointment. Advance to the nearest prospecting method of your choice and spin for results.

12. You did a thorough job qualifying your buyer and have discovered this buyer has:

1. Good income
2. Good credit
3. Cash down payment and closing costs
4. Long time on the job and is motivated to buy today. Move your buyer up to 5 spaces forward, or if you have no buyer, you have just picked up a Motel Buyer type.

13. Time seems to be slipping by. Go to the nearest farm for a listing appointment. Farming in the real world of real estate tends to pull agents out of a slump because they start talking to people about the greatest product in the world: real estate! Spin for listing.

14. You were very well prepared for your last ad call because you knew the inventory so well. Move your buyer forward up to 5 spaces. If no buyer, take new buyer and advance new buyer 5 spaces.

15. You have been previewing property consistently and know your market well. Please advance to the nearest touring and spin for a buyer or advance your buyer up to 5 spaces.

16. You held your open house open 2 hours longer than the slothful competitor of your choice. Consequently, one of his buyers (of your choice) now on the board dropped in and bought one of your existing listings. If you presently have no listings you must understand that for you "virtue is its own reward!" If no buyers on board, place a buyer into your Buyer Pool.

17. Your enthusiastic and positive mental attitude about life and real estate is very contagious. Move a new or existing buyer up to 5 spaces.

18. You have been consistent about keeping in touch with old clients because of your good follow-up program. Your last contact resulted in taking a new listing.

19. You have had three qualifying appointments with buyers as a result of last week's open house. Move to nearest touring and spin for one of the 8 types of buyers.

20. You have been making 25 reverse directory telephone calls a day for the last 2 weeks. Congratulations! You have just picked up a new listing!

21. One of your competitors' buyers has just bounced a deposit check on a recent sale, and the sale has fallen through. Remove one of your competitors' buyers from the board.

22. One of your prospective buyers has just won the Irish Sweepstakes! Move a new or existing buyer to your nearest listing. If you have no listings, move a new or existing buyer to the nearest listing and coop the sale with that agent splitting the 20 points equally.

23. You have been holding open houses diligently. Please advance your buyer to your nearest listing. If you have no buyer, spin for one of the 8 types of buyers and advance in accordance with your spin. On the other hand, if you are presently listless, use the prospecting method of your choice and go for a listing.

What is claimed is:

1. A game apparatus comprising:

a first game piece representing a buyer;

a second game piece representing a prospecting agent;

a third game piece representing a property listed for sale;

a chance device actuable by a player, said chance device being provided with a plurality of coded indicia and a pluraltiy of numerals; and a game playing area, said game playing area including, a first track (buyer track) having a series of first spaces constituting a path along which said first game piece representing a buyer can move in a number of steps dependent upon numerical indications randomly selected by actuation of said chance device, a series of second spaces adjacent ones of said first spaces, upon which said third game piece may be placed; and a second track (prospecting circuit) having a series of spaces constituting a path along which said second game piece representing a prospecting agent can move in a number of steps dependent upon numerical indications randomly selected by actuation of said chance device, said second track being provided with additional coded indicia on at least one space thereof representative of a basic prospecting-for-listing business action, said additional coded indicia on said second track corresponding to one of said plurality of coded indicia on said chance device;

said first game piece being distinguishable from said second and third game pieces, said first game piece having means correlating said first game piece with said first track;

said second game piece being distinguishable from said first and third game pieces, said secnd game piece having means correlating said second game piece with said second track;

said third game piece being distinguishable from said first and second game pieces, whereby a game can progress utilizing said second track or said first track in either a "prospecting" or a "working with buyer" mode, respectively, in accordance with which mode is selected by a player and, whereby a property for listing is obtainable by a player (said player having selected said "prospecting mode") dependent upon an identity of coded indicia on said one space of said second track and similar coded indicia randomly selected by further actuation of said chance device.

2. The apparatus of claim 1 wherein said second track is provided with labels on one of said spaces thereon, to provide labeled spaces which relate to prospecting-for-listing types of action, said second track being provided with further coded indicia on a number of said labeled spaces, in addition to the labels thereon, said number being less than the total number of labeled spaces, whereby a player is able to introduce said third (property) game piece into play on one of said series of second spaces, and alternatively, a player is able to introduce said first game piece into play on said first track (buyer track) in accordance with whether or not said one of said labeled spaces also has said coded indicia thereon.

3. The combination in accordance with claim 1 or 2 wherein said additional coded indicia includes at least one color.

4. A game apparatus comprising the combination of:

a buyer game piece representing a property buyer;

an agent game piece representing a property-selling agent;

a property game piece representing a property listed for sale;

a chance device actuable by a player, said chance device being provided with a plurality of coded indicia and a plurality of numerals; and a game playing area including, a first track (buyer track) comprising a series of first spaces constituting a continuous path along which said buyer game piece is movable in a number of steps determined by actuation of said chance device during the course of play, a second track (prospecting circuit) comprising a series of second spaces constituting a continuous path along which said agent game piece is movable in a number of steps determined by actuation of said chance device during the course of play, said second track being provided with labels on ones of said second spaces thereof, to provide labeled spaces which relate to property prospecting-for-listing types of action, said second track (prospecting circuit) being provided with coded indicia on a number of said labeled second spaces, in addition to the label thereon, said number being less than the total number of labeled second spaces, said coded indicia on said second track corresponding to at least one of said plurality of coded indicia on said chance device;

a plurality of third spaces, adapted to receive said property game piece, said third spaces being located adjacent said first spaces of said first track, said buyer, agent and property game pieces being distinguishable from each other, said buyer game piece being correlated with said first track, said agent game piece being correlated with said second track, each of said first spaces, said second spaces, and said third spaces, being arranged with respect to each other on said playing area such that said agent game piece is free to progress independently along said second track during the course of play, and to land on one of said labeled spaces, which thereby allows a player to introduce said property game piece into play on one of said plurality of third spaces, and, alternately, allows a player to introduce said buyer game piece into play on said first track (buyer track) in accordance with whether or not said one of said labeled spaces also has said coded indicia thereon, and during the course of further play, said buyer game piece is free to progress independently along said first track and to land on one of said first spaces adjacent a third space upon which said property game piece may have been placed to thereby consummate the sale of said property to said buyer.

* * * * *